US007651386B2

(12) United States Patent
Sung

(10) Patent No.: US 7,651,386 B2
(45) **Date of Patent: *Jan. 26, 2010**

(54) METHODS OF BONDING SUPERABRASIVE PARTICLES IN AN ORGANIC MATRIX

(76) Inventor: Chien-Min Sung, 4, Lane 32, Chung-Cheng Road, Tansui, Taipei County 251 (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/804,221

(22) Filed: May 16, 2007

(65) Prior Publication Data

US 2007/0264918 A1 Nov. 15, 2007

Related U.S. Application Data

(63) Continuation of application No. 11/223,786, filed on Sep. 9, 2005.

(51) Int. Cl.
*B24B 1/00* (2006.01)

(52) U.S. Cl. ..... 451/56; 51/295

(58) Field of Classification Search ..... 451/443; 51/293, 295, 296, 308
See application file for complete search history.

(56) References Cited

U.S. PATENT DOCUMENTS

| | | | | |
|---|---|---|---|---|
| 3,743,489 | A | 7/1973 | Wentorf, Jr. et al. | |
| 3,767,371 | A | 10/1973 | Wentorf et al. | |
| 3,852,078 | A | 12/1974 | Wakatsuki et al. | |
| 4,481,016 | A | 11/1984 | Campbell et al. | |
| 4,662,896 | A | 5/1987 | Dennis | |
| 4,849,602 | A | 7/1989 | Gardner | |
| 4,923,490 | A | 5/1990 | Johnson et al. | |
| 4,925,457 | A * | 5/1990 | deKok et al. | 51/293 |
| 5,049,165 | A * | 9/1991 | Tselesin | 51/295 |
| 5,137,543 | A | 8/1992 | Heath et al. | |
| 5,190,568 | A | 3/1993 | Tselesin | |
| 5,195,403 | A | 3/1993 | Sani et al. | |
| 5,195,404 | A | 3/1993 | Notter et al. | |
| 5,232,320 | A | 8/1993 | Tank et al. | |
| 5,247,765 | A | 9/1993 | Quintana | |

(Continued)

FOREIGN PATENT DOCUMENTS

WO WO 2004/094106 11/2004

OTHER PUBLICATIONS

Office Action from U.S. Appl. No. 11/223,786, filed Sep. 9, 2005, Sung, Chien-min.

(Continued)

*Primary Examiner*—Maurina Rachuba
(74) *Attorney, Agent, or Firm*—Thorpe North & Western LLP

(57) ABSTRACT

Superabrasive tools and their methods of manufacture are disclosed. In one aspect, a method of improving retention of superabrasive particles held in a solidified organic material layer of an abrading tool, a portion of each of said superabrasive particles protruding out of the solidified organic material layer is provided. The method may include securing a plurality of superabrasive particles in the solidified organic material layer in an arrangement that minimizes mechanical stress impinging on the protruding portion of any individual superabrasive particle when used to abrade a work piece. As an example, the arrangement of the plurality of superabrasive particles may be configured to uniformly distribute frictional forces across substantially each superabrasive particle.

11 Claims, 4 Drawing Sheets

U.S. PATENT DOCUMENTS

| | | | | |
|---|---|---|---|---|
| 5,380,390 | A | 1/1995 | Tselesin | |
| 5,453,106 | A | 9/1995 | Roberts | |
| 5,505,272 | A | 4/1996 | Clark | |
| 5,560,745 | A | 10/1996 | Roberts | |
| 5,851,138 | A | 12/1998 | Hempel, Jr. | |
| 5,924,917 | A | 7/1999 | Benedict et al. | |
| 5,975,988 | A | 11/1999 | Christianson | |
| 6,027,659 | A | 2/2000 | Billett | |
| 6,054,183 | A * | 4/2000 | Zimmer et al. | 427/249.8 |
| 6,093,280 | A | 7/2000 | Kirchner et al. | |
| 6,213,856 | B1 | 4/2001 | Cho et al. | |
| 6,217,413 | B1 | 4/2001 | Christianson | |
| 6,293,854 | B1 | 9/2001 | Kimura et al. | |
| 6,319,108 | B1 | 11/2001 | Adefris et al. | |
| 6,346,202 | B1 | 2/2002 | Molnar | |
| 6,368,198 | B1 * | 4/2002 | Sung et al. | 451/443 |
| 6,371,842 | B1 | 4/2002 | Romero | |
| 6,446,740 | B2 | 9/2002 | Eyre | |
| 6,478,831 | B2 * | 11/2002 | Tselesin | 51/293 |
| 6,694,847 | B2 | 2/2004 | Hiroyasu et al. | |
| 6,755,720 | B1 * | 6/2004 | Ishizaki et al. | 451/443 |
| 6,884,155 | B2 | 4/2005 | Sung et al. | |
| 6,945,857 | B1 | 9/2005 | Doan et al. | |
| 7,021,995 | B2 | 4/2006 | Toge et al. | |
| 7,033,408 | B2 | 4/2006 | Fries et al. | |
| 7,044,990 | B2 * | 5/2006 | Ishizaki et al. | 451/443 |
| 7,066,795 | B2 | 6/2006 | Balagani et al. | |
| 7,201,645 | B2 | 4/2007 | Sung | |
| 7,258,708 | B2 * | 8/2007 | Sung | 451/443 |
| 7,261,621 | B2 | 8/2007 | Moon et al. | |
| 7,465,217 | B2 * | 12/2008 | Kinoshita et al. | 451/443 |
| 2001/0009844 | A1 | 7/2001 | Cho et al. | |
| 2002/0042200 | A1 | 4/2002 | Fawcett | |
| 2002/0127962 | A1 | 9/2002 | Cho et al. | |
| 2003/0084894 | A1 * | 5/2003 | Sung | 451/533 |
| 2003/0114094 | A1 | 6/2003 | Myoung et al. | |
| 2003/0207659 | A1 | 11/2003 | Annen et al. | |
| 2005/0118939 | A1 | 6/2005 | Duescher | |
| 2005/0260939 | A1 | 11/2005 | Andrews et al. | |
| 2006/0143991 | A1 | 7/2006 | Sung | |
| 2007/0051355 | A1 * | 3/2007 | Sung | 125/12 |
| 2007/0155298 | A1 | 7/2007 | Sung | |
| 2007/0249270 | A1 | 10/2007 | Sung | |
| 2007/0264918 | A1 | 11/2007 | Sung | |

OTHER PUBLICATIONS

U.S. Appl. No. 11/724,585, filed Mar. 14, 2007, Chien-Min Sung. Office action issued Aug. 14, 2008.
U.S. Appl. No. 11/786,426, filed Apr. 10, 2007, Chien-Min Sung. Office Action issued Dec. 3, 2008.
U.S. Appl. No. 11/223,786, filed Sep. 9, 2005, Chien-Min Sung. Office Action issued Jan. 8, 2009.
U.S. Appl. No. 11/724,585, filed Mar. 14, 2007, Chien-Min Sung. Office Action issued Jan. 28, 2009.
U.S. Appl. No. 11/357,713, filed Feb. 17, 2006, Chien-Min Sung. Office Action issued Jan. 30, 2009.
U.S. Appl. No. 11/560,817, filed Nov. 16, 2006, Chien-Min Sung, final office action issued Jun. 4, 2008.
U.S. Appl. No. 11/786,426, filed Apr. 10, 2007, Chien-Min Sung, Office Action issued Jun. 3, 2008.
Syndite, elementsix advancing diamond, CTM 302, 2 pages.
U.S. Appl. No. 11/786,426, filed Apr. 10, 2007, Chien-Min Sung. Office Action issued Mar. 13, 2009.
U.S. Appl. No. 11/560,817, filed Nov. 16, 2006, Chien-Min Sung. Final Office Action issued Jun. 4, 2009.
U.S. Appl. No. 11/223,786 filed Sep. 9, 2005, Chien-Min Sung. Office Action issued Jun. 17, 2009.
U.S. Appl. No. 11/724,585 filed Mar. 14, 2007, Chien-Min Sung. Office Action issued Jul. 27, 2009.
U.S. Appl. No. 11/357,713 filed Feb. 17, 2006, Chien-Min Sung. Office Action issued Aug. 3, 2009.
U.S. Appl. No. 11/357,713 filed Feb. 17, 2006, Chien-Min Sung. Office action issued Aug. 3, 2009.

* cited by examiner

METHODS OF BONDING SUPERABRASIVE PARTICLES IN AN ORGANIC MATRIX

PRIORITY DATA

This application is a continuation of U.S. patent application Ser. No. 11/223,786, filed Sep. 9, 2005, which is incorporated herein by reference.

FIELD OF THE INVENTION

The present invention relates generally to tools having superabrasive particles embedded in an organic material matrix and associated methods. Accordingly, the present invention involves the chemical and material science fields.

BACKGROUND OF THE INVENTION

Many industries utilize a chemical mechanical polishing (CMP) process for polishing certain work pieces. Particularly, the computer manufacturing industry relies heavily on CMP processes for polishing wafers of ceramics, silicon, glass, quartz, and metals. Such polishing processes generally entail applying the wafer against a rotating pad made from a durable organic substance such as polyurethane. A chemical slurry is utilized that contains a chemical capable of breaking down the wafer substance and an amount of abrasive particles which act to physically erode the wafer surface. The slurry is continually added to the rotating CMP pad, and the dual chemical and mechanical forces exerted on the wafer cause it to be polished in a desired manner.

Of particular importance to the quality of polishing achieved is the distribution of the abrasive particles throughout the pad. The top of the pad holds the particles by means of fibers or small pores, which provide a friction force sufficient to prevent the particles from being thrown off of the pad due to the centrifugal force exerted by the pad's spinning motion. Therefore, it is important to keep the top of the pad as flexible as possible, to keep the fibers as erect as possible, and to assure that there is an abundance of open pores available to receive newly applied abrasive particles.

One problem that arises with regard to maintaining the pad surface, however, is an accumulation of polishing debris coming from the work piece, the abrasive slurry, and the pad dresser. This accumulation causes a "glazing" or hardening of the top of the pad, mats the fibers down, and thus makes the pad surface less able to hold the abrasive particles of the slurry. These effects significantly decrease the pad's overall polishing performance. Further, with many pads, the pores used to hold the slurry, become clogged, and the overall asperity of the pad's polishing surface becomes depressed and matted. A CMP pad dresser can be used to revive the pad surface by "combing" or "cutting" it. This process is known as "dressing" or "conditioning" the CMP pad. Many types of devices and processes have been used for this purpose. One such device is a disk with a plurality of superhard crystalline particles such as diamond particles attached to a metal-matrix surface.

Ultra-large-scale integration (ULSI) is a technology that places at least 1 million circuit elements on a single semiconductor chip. In addition to the tremendous density issues that already exist, with the current movement toward size reduction, ULSI has become even more delicate, both in size and materials than ever before. Therefore, the CMP industry has been required to respond by providing polishing materials and techniques that accommodate these advances. For example, lower CMP polishing pressures, smaller size abrasive particles in the slurry, and polishing pads of a size and nature that do not over polish the wafer must be used. Furthermore, pad dressers that cut asperities in the pad which can accommodate the smaller abrasive particles, and that do not overdress the pad must be used.

There are a number of problems in attempting to provide such a pad dresser. First, the superabrasive particles must be significantly smaller than those typically used in currently know dressing operations. Generally speaking, the superabrasive particles are so small that a traditional metal matrix is often unsuitable for holding and retaining them. Further, the smaller size of the superabrasive particles, means that the particle tip height must be precisely leveled in order to uniformly dress the pad. Traditional CMP pad dressers can have particle tip height variations of more than 50 μm without compromising dressing performance. However, such a variation would render a dresser useless if it were required to dress a CMP pad and achieve a uniform asperity depth of 20 μm or less, for example.

In addition to issues with properly holding very small superabrasive particles, the tendencies of metal to warp and buckle during a heating process, cause additional issues in obtaining a CMP pad dresser having superabrasive particle tips leveled to within a narrow tolerance range. While other substrate materials such as polymeric resins have been known, such materials typically are not able to retain superabrasive particles to a degree that is sufficient for CMP pad dressing.

As a result, a CMP pad dresser that is suitable for dressing a CMP pad that meet the demands placed upon the CMP industry by the continual reductions in semiconductor size is still being sought.

SUMMARY OF THE INVENTION

Accordingly, the present invention provides superabrasive tools and methods that are, without limitation, suitable to groom the CMP pads used for the delicate polishing applications as recited above. In one aspect, a method is provided for improving retention of superabrasive particles held in a solidified organic material layer of an abrading tool, where a portion of each of the superabrasive particles protrude out of the solidified organic material layer. The method may include securing a plurality of superabrasive particles in the solidified organic material layer in an arrangement that minimizes mechanical stress impinging on the protruding portion of any individual superabrasive particle when used to abrade a work piece. As an example, the arrangement of the plurality of superabrasive particles may be configured to uniformly distribute drag forces across substantially each superabrasive particle.

Various methods are contemplated for minimizing the mechanical stress impinging on the superabrasive particles held in the abrading tool. One example may include superabrasive particle arrangement according to protrusion height. As such, each of the plurality of superabrasive particles may protrude to a predetermined height above the solidified organic material layer. In one aspect, the predetermined height may produce a cutting depth of greater than about 20 microns when used to abrade a work piece. In another aspect, the predetermined height may produce a cutting depth of from about 1 micron to about 20 microns when used to abrade a work piece. In yet another aspect, the predetermined height may produce a cutting depth of from about 10 micron to about 20 microns when used to abrade a work piece.

Arranging superabrasive particles such that they define a profile may also prove to be useful in distributing impinging mechanical forces. As such, the superabrasive particles may protrude to a predetermined height that is along a designated profile. In one aspect, the plurality of superabrasive particles may be arranged such that their tips protrude to less than about 40 microns above the organic material matrix. In another aspect, the plurality of superabrasive particles may be arranged such that their tips protrude to less than about 30 microns above the organic material matrix. In yet another aspect, the plurality of superabrasive particles are arranged such that their tips protrude to less than about 20 microns above the organic material matrix. Thus the designated profile defines the extent to which a plurality of superabrasive particles protrude from the solidified organic material layer. In one aspect, the designated profile may be a plane. In another aspect, the designated profile may have a slope. In yet another aspect, the designated profile may have a curved shape. In a further aspect, the designated profile may have a dome shape. Additionally, though it is intended that the plurality of superabrasive particles be arranged according to the designated profile, a small amount of deviation therefrom may be likely.

The size of the plurality of superabrasive particles may also affect the distribution of mechanical forces. In one aspect, the plurality of superabrasive particles may be of substantially the same size. Any superabrasive particle size that would provide benefit to the methods and tools of the present invention are considered to be within the present claim scope. In one specific aspect, the plurality of superabrasive particle may be from about 30 microns to about 250 microns in size. In another aspect, the plurality of superabrasive particles are from about 100 microns to about 200 microns in size. Additionally, variations in the size of the plurality of superabrasive particles or the variation thereof may also affect the distribution of mechanical forces. This is particularly true for tools in which impinging mechanical forces vary depending on superabrasive particle location, such as with circumferentially rotating tools. In one aspect, superabrasive particles in a central location of the abrading tool may be larger in size than superabrasive particles in a peripheral location on the abrading tool.

The orientation of the plurality of superabrasive particles may also affect the distribution of mechanical forces in the abrading tool. In one aspect, securing the plurality of superabrasive particles includes arranging the plurality of superabrasive particles according to a predetermined attitude. Though various attitudes are possible, in one specific aspect the predetermined attitude is a uniform attitude across substantially all of the plurality of superabrasive particles. In another aspect, the plurality of superabrasive particles are substantially configured with an apex portion oriented towards a work piece. In addition to uniform attitudes, some aspects include variations in attitude across the abrading tool. For example, in one aspect superabrasive particles in a central location on the abrading tool may be configured with an apex or an edge portion oriented towards a work piece, and superabrasive particles in a peripheral location on the abrading tool may be configured with a face oriented towards the work piece.

The arrangement or distribution of superabrasive particle along the surface of an abrading tool may also function to effectively distribute mechanical forces. In one aspect, the plurality of superabrasive particles may be arranged as a grid. In another aspect, the plurality of superabrasive particles may be evenly spaced at a distance of from about 2 times to about 4 times the average size of the superabrasive particles. In yet another aspect, the plurality of superabrasive particles may be evenly spaced at a distance of from about 3 times to about 5 times the average size of the superabrasive particles. In a further aspect, superabrasive particles in a central location on the abrading tool may be spaced farther apart than superabrasive particles in a peripheral location on the abrading tool.

The present invention further encompasses superabrasive tools having improved superabrasive particle retention. As such, in one aspect a superabrasive tool may include a solidified organic material layer and a plurality of superabrasive particles secured in the solidified organic material layer in an arrangement according to the methods recited herein.

Any superabrasive material capable of being utilized according to the methods provided herein would be considered to be within the scope of the present invention. For example, the plurality of superabrasive particles may include, without limitation, diamond, polycrystalline diamond, cubic boron nitride, polycrystalline cubic boron nitride, and combinations thereof.

Various organic materials are also contemplated to hold and secure the superabrasive particles. For example, and without limitation, the solidified organic material layer may include amino resins, acrylate resins, alkyd resins, polyester resins, polyamide resins, polyimide resins, polyurethane resins, phenolic resins, phenolic/latex resins, epoxy resins, isocyanate resins, isocyanurate resins, polysiloxane resins, reactive vinyl resins, polyethylene resins, polypropylene resins, polystyrene resins, phenoxy resins, perylene resins, polysulfone resins, acrylonitrile-butadiene-styrene resins, acrylic resins, polycarbonate resins, polyimide resins, and mixtures thereof. The solidified organic material layer may also include additional components that modify the characteristics of the material. In one aspect, a reinforcing material may be disposed within at least a portion of the solidified organic material layer. The reinforcing material may be, without limitation, ceramics, metals, or combinations thereof. Examples of ceramic materials include alumina, aluminum carbide, silica, silicon carbide, zirconia, zirconium carbide, and mixtures thereof.

There has thus been outlined, rather broadly, various features of the invention so that the detailed description thereof that follows may be better understood, and so that the present contribution to the art may be better appreciated. Other features of the present invention will become clearer from the following detailed description of the invention, taken with the accompanying claims, or may be learned by the practice of the invention.

DETAILED DESCRIPTION OF THE INVENTION

Definitions

Figure 1:
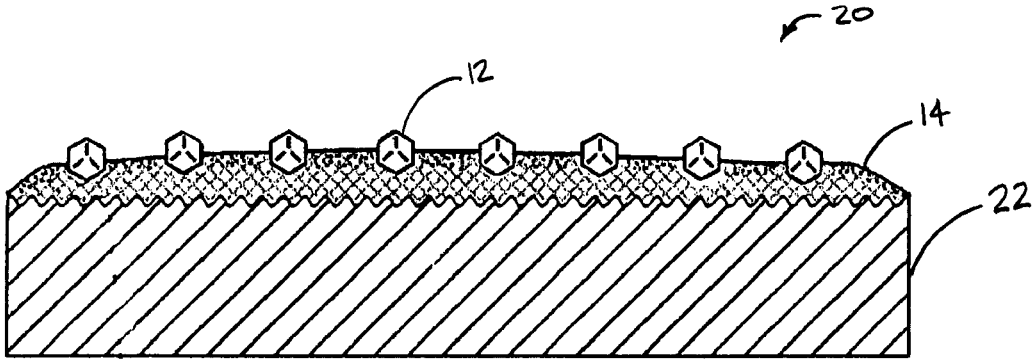
FIG. 1 is a cross-sectional view of a CMP pad dresser made in accordance with one embodiment of the present invention.

In describing and claiming the present invention, the following terminology will be used in accordance with the definitions set forth below.

The singular forms "a," "an," and, "the" include plural referents unless the context clearly dictates otherwise. Thus, for example, reference to "a particle" includes reference to one or more of such particles, and reference to "the resin" includes reference to one or more of such resins.

As used herein, "organic material" refers to a semisolid or solid complex amorphous mix of organic compounds. As such, "organic material layer" and "organic material matrix" may be used interchangeably, refer to a layer or mass of a semisolid or solid complex amorphous mix of organic compounds. Preferably the organic material will be a polymer or copolymer formed from the polymerization of one or more monomers.

As used herein, "superhard" and "superabrasive" may be used interchangeably, and refer to a crystalline, or polycrystalline material, or mixture of such materials having a Vicker's hardness of about 4000 $Kg/mm^2$ or greater. Such materials may include without limitation, diamond, and cubic boron nitride (cBN), as well as other materials known to those skilled in the art. While superabrasive materials are very inert and thus difficult to form chemical bonds with, it is known that certain reactive elements, such as chromium and titanium are capable of chemically reacting with superabrasive materials at certain temperatures.

As used herein, "metallic" refers to a metal, or an alloy of two or more metals. A wide variety of metallic materials is known to those skilled in the art, such as aluminum, copper, chromium, iron, steel, stainless steel, titanium, tungsten, zinc, zirconium, molybdenum, etc., including alloys and compounds thereof.

As used herein, "particle" and "grit" may be used interchangeably, and when used in connection with a superabrasive material, refer to a particulate form of such material. Such particles or grit may take a variety of shapes, including round, oblong, square, euhedral, etc., as well as a number of specific mesh sizes. As is known in the art, "mesh" refers to the number of holes per unit area as in the case of U.S. meshes.

As used herein, "mechanical bond" and "mechanical bonding" may be used interchangeably, and refer to a bond interface between two objects or layers formed primarily by frictional forces. In some cases the frictional forces between the bonded objects may be increased by expanding the contacting surface areas between the objects, and by imposing other specific geometrical and physical configurations, such as substantially surrounding one object with another.

As used herein, "leading edge" means the edge of a CMP pad dresser that is a frontal edge based on the direction that the CMP pad is moving, or the direction that the pad is moving, or both. Notably, in some aspects, the leading edge may be considered to encompass not only the area specifically at the edge of a dresser, but may also include portions of the dresser which extend slightly inward from the actual edge. In one aspect, the leading edge may be located along an outer edge of the CMP pad dresser. In another aspect, the CMP pad dresser may be configured with a pattern of abrasive particles that provides at least one effective leading edge on a central or inner portion of the CMP pad dresser working surface. In other words, a central or inner portion of the dresser may be configured to provide a functional effect similar to that of a leading edge on the outer edge of the dresser.

As used herein, "centrally located particle," "particle in a central location" and the like mean any particle of a tool that is located in an area of the tool that originates at a center point of the tool and extends outwardly towards the tool's edge for up to about 90% of the radius of the tool. In some aspects, the area may extend outwardly from about 20% to about 90% of the radius. In other aspects, the area may extend out to about 50% of the radius. In yet another aspect, the area may extend out to about 33% of the radius of a tool.

As used herein, "peripherally located," "particles in a peripheral location" and the like, mean any particle of a tool that is located in an area that originates at the leading edge or outer rim of a tool and extends inwardly towards the center for up to about 90% of the radius of the tool. In some aspects, the area may extend inwardly from about 20% to 90% of the radius. In other aspects, the area may extend in to about 50% of the radius. In yet another aspect, the area may extend in to about 33% of the radius of a dresser (i.e. 66% away from the center).

As used herein, "working end" refers to an end of a particle which is oriented towards the work piece being abraded by a tool. Most often the working end of a particle will be distal from a substrate to which the particle is attached.

As used herein, "ceramic" refers to a hard, often crystalline, substantially heat and corrosion resistant material which may be made by firing a non-metallic material, sometimes with a metallic material. A number of oxide, nitride, and carbide materials considered to be ceramic are well known in the art, including without limitation, aluminum oxides, silicon oxides, boron nitrides, silicon nitrides, and silicon carbides, tungsten carbides, etc.

As used herein, "grid" means a pattern of lines forming multiple squares.

As used herein, "attitude" means the position or arrangement of a superabrasive particle in relation to a defined surface, such as a substrate to which it is attached, or a work piece to which it is to be applied during a work operation. For example, a superabrasive particle can have an attitude that provides a specific portion of the particle in orientation toward the work piece.

As used herein, "substantially" refers to situations close to and including 100%. Substantially is used to indicate that, though 100% is desirable, a small deviation therefrom is acceptable. For example, substantially all superabrasive particles includes groups of all superabrasive particles and groups of all superabrasive particles minus a relatively small portion of superabrasive particles.

As used herein, "mechanical force" and "mechanical forces" refer to any physical force that impinges on an object that causes mechanical stress within or surrounding the object. Example of mechanical forces would be frictional forces or drag forces. As such, the terms "frictional force" and "drag force" may be used interchangeably, and refer to mechanical forces impinging on an object as described.

As used herein, "mechanical stress" refers to a force per unit area that resists impinging mechanical forces that tend to compact, separate, or slide an object.

As used herein, the term "profile" refers to a contour above an organic material layer surface to which the superabrasive particles are intended to protrude.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc.

This same principle applies to ranges reciting only one numerical value. Furthermore, such an interpretation should apply regardless of the breadth of the range or the characteristics being described.

The Invention

The present invention provides organic material-based CMP pad dressers including methods for their use and manufacture. Though much of the following discussion relates to CMP pad dressers, it should be understood that the methods and tools of the presently claimed invention are equally applicable to any tool that utilizes abrasive or superabrasive materials, all of which are considered to be within the scope of the present invention. The inventor has found that the retention of a superabrasive particle in an organic material layer can be improved by arranging the superabrasive particles in the organic material layer such that mechanical stress impinging on any individual superabrasive particle is minimized. By reducing the stress impinging on each individual superabrasive particle they can be more readily retained in a solidified organic material layer, particularly for delicate tasks.

Accordingly, one aspect of the present invention provides a method of improving retention of superabrasive particles held in a solidified organic material layer of an abrading tool having a portion of the superabrasive particles protruding out of the solidified organic material layer. The method can include securing a plurality of superabrasive particles in the solidified organic material layer in an arrangement that minimizes mechanical stress impinging on the protruding portion of any individual superabrasive particle when used to abrade a work piece. Though various methods of minimizing mechanical stress are possible, in one aspect the arrangement of the plurality of superabrasive particles may be configured to uniformly distribute frictional forces across substantially each superabrasive particle. Such a uniform distribution of frictional force prevents any individual superabrasive particle from being overstressed and pulling out of the solidified organic material layer.

Various configurations or arrangements are contemplated for minimizing the mechanical stress impinging on the superabrasive particles held in the abrading tool. One potentially useful parameter may include the height that the superabrasive particles protrude above the organic material layer. A superabrasive particle that protrudes to a significantly greater height than other superabrasive particles will experience a greater proportion of the impinging mechanical forces and thus is more prone to pull out of the solidified organic material layer. Thus an even height distribution of superabrasive particles may function to more effectively preserve the integrity of the abrading tool as compared to abrading tools lacking such an even height distribution. As such, in one aspect, a majority of the plurality of superabrasive particles may protrude to a predetermined height above the solidified organic material layer. Though any predetermined height that would be useful in an abrading tool would be considered to be within the presently claimed scope, in one specific aspect the predetermined height may produce a cutting depth of less than about 20 microns when used to abrade a work piece. In another specific aspect, the predetermined height may produce a cutting depth of from about 1 micron to about 20 microns when used to abrade a work piece. In yet another specific aspect, the predetermined height may produce a cutting depth of from about 10 micron to about 20 microns when used to abrade a work piece. It should also be noted that the leveling of superabrasive particles to a predetermined height may be dependent on superabrasive particle spacing. In other words, the farther superabrasive particles are separated, the more the impinging forces will affect each superabrasive particle. As such, patterns with increased spacing between the superabrasive particles may benefit from a smaller variation from predetermined height.

It may also be beneficial for the superabrasive particles to protrude from the solidified organic material layer to a predetermined height or series of heights that is/are along a designated profile. Numerous configurations for designated profiles are possible, depending on the particular use of the abrading tool. In one aspect, the designated profile may be a plane. In planar profiles, the highest protruding points of the superabrasive particles are intended to be substantially level. It is important to point out that, though it is preferred that these points align with the designated profile, there may be some height deviation between superabrasive particles that occur due to limitations inherent in the manufacturing process.

In addition to planar profiles, in another aspect of the present invention the designated profile has a slope. Tools having sloping surfaces may function to more evenly spread the frictional forces impinging thereon across the superabrasive particles, particularly for rotating tools such as disk sanders and CMP pad dressers. The greater downward force applied by higher central portions of the tool may offset the higher rotational velocity at the periphery, thus reducing the mechanical stress experienced by superabrasive particles in that location. As such, the slope may be continuous from a central point of the tool to a peripheral point, or the slope may be discontinuous, and thus be present on only a portion of the tool. Similarly, a given tool may have a single slope or multiple slopes. In certain aspects, the tool may slope in a direction from a central point to a peripheral point, or it may slope from a peripheral point to a central point. Various slopes are contemplated that may provide a benefit to solidified organic material layer tools. It is not intended that the claims of the present invention be limited as to specific slopes, as a variety of slopes in numerous different tools are possible. In one aspect, however, a CMP pad dresser may benefit from an average slope of $1/1000$ from the center to the periphery.

As a variation on tools having a slope, in certain aspects the designated profile may have a curved shape. One specific example of a curved shape is a dome shape tool. Such curved profiles function in a similar manner to the sloped surfaces. Tools may include such curved profiles in order to more effectively distribute the frictional forces between all of the superabrasive particles, thus reducing failures of individual particles and prolonging the life of the tool.

As has been mentioned herein, while it is intended that the tips of the superabrasive particles align along the designated profile, some level of deviation may occur. These deviations may be a result of the design or manufacturing process of the tool. Given the wide variety of sizes of superabrasive particles that may potentially be utilized in a given tool, such deviations may be highly dependent on a particular application. Also, when referring to the designated profile, it should be noted that the term "tip" is intended to include the highest protruding point of a superabrasive particle, whether that point be an apex, an edge, or a face. As such, in one aspect a majority of the plurality of superabrasive particles are arranged such that their tips vary from the designated profile by from about 1 micron to about 150 microns. In another aspect, the plurality of superabrasive particles are arranged such that their tips vary from the designated profile by from about 5 microns to about 100 microns. In yet another aspect, the plurality of superabrasive particles are arranged such that their tips vary from the designated profile by from about 10 microns to about 75 microns. In a further aspect, the plurality of superabrasive particles are arranged such that their tips vary from the designated profile by from about 10 microns to about 50 microns. In another aspect, the plurality of superabrasive particles are arranged such that their tips vary from the designated profile by from about 50 microns to about 150 microns. In yet another aspect, the plurality of superabrasive particles are arranged such that their tips vary from the designated profile by from about 20 microns to about 100 microns. In a further aspect, the plurality of superabrasive particles are arranged such that their tips vary from the designated profile by from about 20 microns to about 50 microns. In another aspect, the plurality of superabrasive particles are arranged such that their tips vary from the designated profile by from about 20 microns to about 40 microns. Additionally, in one aspect, the plurality of superabrasive particles are arranged such that their tips vary from the designated profile by less than about 20 microns. In another aspect the plurality of superabrasive particles are arranged such that their tips vary from the designated profile by less than about 10 microns. In yet another aspect, the plurality of superabrasive particles are arranged such that their tips vary from the designated profile by less than about 5 microns. In yet another aspect, the plurality of superabrasive particles are arranged such that their tips vary from the designated profile by less than about 1 microns. In a further aspect, a majority of the plurality of superabrasive particles are arranges such that their tips vary from the designated profile to less than about 10% of the average size of the superabrasive particles.

Variations in superabrasive particle size between different locations on the tool may also help to more evenly distribute the frictional forces impinging thereon. Larger superabrasive particles will most likely experience greater frictional force than would smaller particles. Additionally, in the case circumferentially rotating tools such as CMP pad dressers, superabrasive particles located near the periphery will most likely experience greater frictional force than particles located more centrally due to the greater rotational velocity at the periphery. In such a case, frictional forces may be distributed across the CMP pad by locating larger superabrasive particles more centrally to offset this increase. As a result, the frictional forces are more evenly spread across all superabrasive particles, thus reducing particle failure. As such, in one aspect superabrasive particles in a central location of the abrading tool are larger in size than superabrasive particles in a peripheral location on the abrading tool. In another aspect, superabrasive particles in a central location of the abrading tool may be smaller than superabrasive particles in a peripheral location on the abrading tool. This configuration may provide benefit to circumferentially rotating tools, where the mechanical stresses on superabrasive particles are greater at the periphery. The larger superabrasive particles extend deeper into the organic material layer, and are thus more firmly supported therein. Also, for CMP pad dressers, larger particles at the periphery may provide more slurry clearance than smaller particles. Additionally, although a variety of sizes are contemplated, in one aspect the plurality of superabrasive particle may be from about 30 microns to about 500 microns in size. In another aspect the plurality of superabrasive particles are from about 100 microns to about 200 microns in size. It is also contemplated that the plurality of superabrasive particles may be of substantially the same size.

Variations in the attitude of superabrasive particles in the solidified organic material layer may also function to more effectively distribute frictional forces across the abrading tool. Orienting superabrasive particles in particular locations of the abrading tool such that similar apexes, edges, and/or faces are exposed may allow a more even distribution of frictional forces, particularly if the densities of superabrasive particles in those locations are concomitantly arranged. As such, in one aspect securing the plurality of superabrasive particles in the solidified organic material layer may include arranging the plurality of superabrasive particles according to a predetermined attitude. In various aspects, the predetermined attitude may be a uniform attitude across substantially all of the plurality of superabrasive particles. In other words, similar apexes, edges, or faces for substantially all of the superabrasive particles in the abrading tool may be facing the same direction. In one aspect, the plurality of superabrasive particles may be substantially configured with an apex portion oriented towards a work piece. As such, impinging frictional forces may be reduced by orienting the plurality of superabrasive particles such that their tips or apexes are substantially oriented towards the work piece. This may be partially due to the smaller surface area of the apex region of the superabrasive particles coming in contact with the work piece during abrading as compared to the larger surface areas of the edge or face regions. Also, the attitude of the plurality of superabrasive particles can also vary depending on the location of particles on the abrading tool. For example, in one aspect superabrasive particles in a central location on the abrading tool may be configured with an apex or an edge portion oriented towards a work piece, and superabrasive particles in a peripheral location on the abrading tool may be configured with a face oriented towards the work piece. In another aspect, superabrasive particles in a central location on the abrading tool may be configured with an apex portion oriented towards a work piece, superabrasive particles in a peripheral location on the abrading tool may be configured with a face oriented towards the work piece, and superabrasive particles in a middle location on the abrading tool may be configured with an edge oriented towards the work piece.

It may be preferable to utilize superabrasive particles smaller than about 40 microns when orienting face portions towards the work piece. In this case, the face is not big enough to overstress those superabrasive particles. Faces also have the advantage of having four edges that can be used to cut the work piece.

The distribution of frictional forces may also be varied through the arrangement or distribution of the superabrasive particles in the solidified organic material layer. For example, in one aspect the plurality of superabrasive particles may be arranged as a grid. Though the even or uniform spacing of the superabrasive particle can exhibit wide variation across abrading tools, in one specific aspect the plurality of superabrasive particles may be evenly spaced at a distance of from about 2 times to about 4 times the average size of the superabrasive particles. In another specific aspect the plurality of superabrasive particles may be evenly spaced at a distance of from about 3 times to about 5 times the average size of the superabrasive particles. In yet another specific aspect the plurality of superabrasive particles may be evenly spaced at a distance of from about 3 times to about 4 times the average size of the superabrasive particles. In a further aspect, the plurality of superabrasive particles may be evenly spaced at a distance of from about 4 times to about 5 times the average size of the superabrasive particles. In yet another aspect, the plurality of superabrasive particles may be evenly space at a distance of from about 100 microns to about 800 microns. As has been discussed herein, however, if all superabrasive particles are evenly spaced, those particles near the periphery will experience greater mechanical stress due to the higher rotational velocity of the abrading tool at that location. The larger the tool, the greater the disparity in the impinging mechanical forces between the center of the tool and the periphery. Because of this, it may be beneficial to vary the spacing of the superabrasive particle depending on location to more effectively distribute frictional forces across the abrading tool. In one aspect, for example, superabrasive particles in a central location on the abrading tool may be spaced farther apart than superabrasive particles in a peripheral location on the abrading tool. In this way, the increased frictional forces due to the greater density of superabrasive particles in the central location may offset the increased frictional forces at the periphery due to the greater rotational velocity of the abrading tool.

Turning to organic material layers, numerous organic materials are known to those skilled in the art which would be useful when utilized in embodiments of the present invention, and are considered to be included herein. The organic material layer can be any curable resin material, resin, or other polymer with sufficient strength to retain the superabrasive grit of the present invention. It may be beneficial to use an organic material layer that is relatively hard, and maintains a flat surface with little or no warping. This allows the abrading tool to incorporate very small superabrasive particles at least partially therein, and to maintain these small superabrasive particles at relatively level and consistent heights. Additionally, various organic materials may act to absorb mechanical forces impinging on the superabrasive particles disposed therein, and thus spread and equalize such forces across the abrading tool.

Methods of curing the organic material layer can be any process known to one skilled in the art that causes a phase transition in the organic material from at least a pliable state to at least a rigid state. Curing can occur, without limitation, by exposing the organic material to energy in the form of heat, electromagnetic radiation, such as ultraviolet, infrared, and microwave radiation, particle bombardment, such as an electron beam, organic catalysts, inorganic catalysts, or any other curing method known to one skilled in the art. In one aspect of the present invention, the organic material layer may be a thermoplastic material. Thermoplastic materials can be reversibly hardened and softened by cooling and heating respectively. In another aspect, the organic material layer may be a thermosetting material. Thermosetting materials cannot be reversibly hardened and softened as with the thermoplastic materials. In other words, once curing has occurred, the process is essentially irreversible.

Organic materials that may be useful in embodiments of the present invention include, but are not limited to: amino resins including alkylated urea-formaldehyde resins, melamine-formaldehyde resins, and alkylated benzoguanamine-formaldehyde resins; acrylate resins including vinyl acrylates, acrylated epoxies, acrylated urethanes, acrylated polyesters, acrylated acrylics, acrylated polyethers, vinyl ethers, acrylated oils, acrylated silicons, and associated methacrylates; alkyd resins such as urethane alkyd resins; polyester resins; polyamide resins; polyimide resins; reactive urethane resins; polyurethane resins; phenolic resins such as resole and novolac resins; phenolic/latex resins; epoxy resins such as bisphenol epoxy resins; isocyanate resins; isocyanurate resins; polysiloxane resins including alkylalkoxysilane resins; reactive vinyl resins; resins marketed under the Bakelite trade name, including polyethylene resins, polypropylene resins, epoxy resins, phenolic resins, polystyrene resins, phenoxy resins, perylene resins, polysulfone resins, ethylene copolymer resins, acrylonitrile-butadiene-styrene (ABS) resins, acrylic resins, and vinyl resins; acrylic resins; polycarbonate resins; and mixtures and combinations thereof. In one aspect of the present invention, the organic material may be an epoxy resin. In another aspect, the organic material may be a polyimide resin. In yet another aspect, the organic material may be a polyurethane resin. In yet another aspect, the organic material may be a polyurethane resin.

Numerous additives may be included in the organic material to facilitate its use. For example, additional crosslinking agents and fillers may be used to improve the cured characteristics of the organic material layer. Additionally, solvents may be utilized to alter the characteristics of the organic material in the uncured state. Also, a reinforcing material may be disposed within at least a portion of the solidified organic material layer. Such reinforcing material may function to increase the strength of the organic material layer, and thus further improve the retention of the superabrasive particles. In one aspect, the reinforcing material may include ceramics, metals, or combinations thereof. Examples of ceramics include alumina, aluminum carbide, silica, silicon carbide, zirconia, zirconium carbide, and mixtures thereof.

Additionally, in one aspect a coupling agent or an organometallic compound may be coated onto the surface of each superabrasive particle to facilitate the retention of the superabrasive particles in the organic material matrix via chemical bonding. A wide variety of organic and organometallic compounds are known to those of ordinary skill in the art and may be used. Organometallic coupling agents can form chemicals bonds between the superabrasive particles and the organic material matrix, thus increasing the retention of the particles therein. In this way, the organometallic coupling agent acts as a bridge to form bonds between the organic material matrix and the surface of the superabrasive particles. In one aspect of the present invention, the organometallic coupling agent can be a titanate, zirconate, silane, or mixture thereof.

Specific non-limiting examples of silanes suitable for use in the present invention include: 3-glycidoxypropyltrimethoxy silane (available from Dow Corning as Z-6040); γ-methacryloxy propyltrimethoxy silane (available from Union Carbide Chemicals Company as A-174); β-(3,4-epoxycyclohexyl)ethyltrimethoxy silane, γ-aminopropyltriethoxy silane, N-(β-aminoethyl)-γ-aminopropylmethyldimethoxy silane (available from Union Carbide, Shin-etsu Kagaku Kogyo K. K., etc.); and additional examples of suitable silane coupling agents can be found in U.S. Pat. Nos. 4,795,678, 4,390,647, and 5,038,555, which are each incorporated herein by reference.

Specific non-limiting examples of titanate coupling agents include: isopropyltriisostearoyl titanate, di(cumylphenylate) oxyacetate titanate, 4-aminobenzenesulfonyldodecylbenzenesulfonyl titanate, tetraoctylbis (ditridecylphosphite) titanate, isopropyltri(N-ethylamino-ethylamino) titanate (available from Kenrich Petrochemicals. Inc.), neoalkyoxy titanates such as LICA-01, LICA-09, LICA-28, LICA-44 and LICA-97 (also available from Kenrich), and the like.

Specific non-limiting examples of aluminum coupling agents include acetoalkoxy aluminum diisopropylate (available from Ajinomoto K. K.), and the like.

Specific non-limiting examples of zirconate coupling agents include: neoalkoxy zirconates, LZ-01, LZ-09, LZ-12, LZ-38, LZ-44, LZ-97 (all available from Kenrich Petrochemicals, Inc.), and the like. Other known organometallic coupling agents, e.g., thiolate based compounds, can be used in the present invention and are considered within the scope of the present invention.

The amount of organometallic coupling agent used depends on the coupling agent and on the surface area of the superabrasive particles. Typically, 0.05% to 10% by weight of the organic material layer is sufficient.

The superabrasive particles used in embodiments of the present invention may be selected from a variety of specific types of diamond (e.g., polycrystalline diamond) and cubic boron nitride (e.g., polycrystalline cBN). It may be useful to select a superabrasive material capable of chemically bonding with a reactive material, such as those described herein. Further, these particles may take a number of different shapes as required to accommodate a specific purpose for the tool into which it is anticipated that they will be incorporated. However, in one aspect, the superabrasive particle may be diamond, including natural diamond, synthetic diamond, and polycrystalline diamond (PCD). In yet another aspect, the superabrasive particle may be cubic boron nitride (cBN), either single crystals or polycrystalline. In yet another aspect, the superabrasive particle may be a member selected from the group consisting of SiC, $Al_2O_3$, $ZrO_2$, and WC.

Numerous uses of aspects of the present invention will be apparent to one skilled in the art in possession of the present disclosure. Superabrasive particles can be arranged into tools of various shapes and sizes, including one-, two-, and three-dimensional tools. Tools may incorporate a single layer or multiple layers of superabrasive particles and may exhibit improved retention through the distribution of impinging frictional forces. In one aspect, for example, a superabrasive tool having improved superabrasive particle retention is provided. The superabrasive tool may include a solidified organic material layer and a plurality of superabrasive particles secured in the solidified organic material layer in an arrangement according to the methods recited herein.

Superabrasive particles can be arranged in various configurations that may help to distribute the frictional forces impinging on the too. For example, in one aspect each of the plurality of superabrasive particles may protrude to a predetermined height above the solidified organic material layer. By minimizing the variance in the protrusion of the plurality of superabrasive particles above the solidified organic material layer, mechanical forces impinging on individual superabrasive particles can be minimized. Though the predetermined height may vary between tool applications, in one aspect the predetermined height may be greater than about 20 microns. In another aspect the variation from the predetermined height may be from about 1 micron to about 20 microns. In yet another aspect the variation from the predetermined height may be from about 5 microns to about 20 microns. In a further aspect the variation from the predetermined height may be from about 10 microns to about 20 microns. Superabrasive particles may also be arranged according to the methods disclosed herein with respect to arrangement or distribution, attitude, size, etc.

One example of a tool incorporating a single layer of superabrasive particles in an organic material matrix is a CMP pad dresser. As recited herein, traditional metal matrix CMP pad dressers are not suitable for bonding very small superabrasive particles. It is intended that the scope of the present invention include superabrasive particles of all conceivable sizes that would be useful in dressing a CMP pad. Aspects of the present invention, however, specifically allow the retention of superabrasive particles in a CMP pad dresser of sizes that have not previously been feasible for use in metal tools with particles exposed and arranged in a pattern. In one aspect, superabrasive particles may range in size from about 30 microns to about 250 microns. In another aspect, superabrasive particles may range in size from about 100 microns to about 200 microns. In yet another aspect, superabrasive particles can range from 100 microns to 150 microns.

Embodiments of the present invention also provide CMP pad dressers with improved superabrasive particle retention as recited herein. Referring to FIG. 1, the CMP pad dresser 20 may include an organic material layer 14 and superabrasive particles 12 held in the organic material layer 14 in an arrangement according to the various methods presented herein. Such an arrangement may increase the retention of the superabrasive particles 12 in the organic material layer 14 due to a substantially even distribution of frictional forces across all the superabrasive particles in the tool. This distribution of forces improves retention by minimizing mechanical stress impinging on any individual particle. Additionally, in one aspect the organic material layer 14 may be coupled to a support substrate 22.

In order for the CMP pad dresser 20 to condition a CMP pad, the superabrasive particles 12 should protrude at least partially from the organic material layer 14. The protruding superabrasive particles 12 can cut into the CMP pad to a depth that is essentially the distance of the protrusion. In one aspect of the present invention, the superabrasive particles can protrude to a predetermined height. The heights of each superabrasive particle can be essentially the same, or they may vary depending on the particular application of the dresser. For example, superabrasive particles near the center of the CMP pad dresser may protrude to a greater height than the superabrasive grit near the dresser periphery.

Various methods for making a CMP pad dresser according to embodiments of the present invention may be contemplated by one of skill in the art. Generally, a method for making a CMP pad dresser may include disposing superabrasive particles in an organic material layer according to an arrangement such that the superabrasive particles protrude at least partially from the organic material layer. As described herein, the superabrasive particles may be arranged in order to distribute frictional forces across the tool in order to improve retention. In one aspect of the present invention, a reinforcing material may also be applied to at least a portion of the organic material layer in the proximity of the superabrasive grit to further improve retention. The reinforcing material may also protect the organic material layer from acid and provide wear resistance. In one aspect, the reinforcing material may be a ceramic powder. As discussed herein, the ceramic powder may be any ceramic powder known to one skilled in the art, including alumina, aluminum carbide, silica, silicon carbide, zirconia, zirconium carbide, and mixtures thereof. In one aspect the ceramic powder is silicon carbide. In another aspect, the ceramic powder is aluminum carbide. In yet another aspect, the ceramic powder is silica.

Disposing superabrasive grit according to an arranged pattern may be accomplished by applying spots of glue to a substrate, by creating indentations in the substrate to receive the particles, by adhesive transfer, vacuum transfer, or by any other means known to one skilled in the art. Additional methods may be found in U.S. Pat. Nos. 6,039,641 and 5,380,390, which are incorporated herein by reference.

Orienting superabrasive particles according to a particular attitude can be accomplished by various methods, all of which would be considered to be within the scope of the present invention. For example, in various aspects the plurality of superabrasive particles may have an apex oriented away from the plane of the organic material matrix. In one specific aspect, superabrasive particles may be picked up and positioned with a surface containing numerous flared holes providing suction. An apex portion of a superabrasive particle is sucked into the flared section of each of the holes in the surface. Because the flared portion and the holes are smaller than the superabrasive particles, the particles will be held in a pattern along the surface. Also, due to the shape of the flared sections, the apex portions of the superabrasive particles will be oriented towards the surface. This pattern of superabrasive particles can then be disposed along a substrate having an adhesive or directly into an organic material matrix. Accordingly, the tips of the superabrasive particles will have the same orientation or attitude and also be substantially leveled.

In another aspect, it may be desired to orient apexes and edges away from the plane of the organic material matrix. This can be accomplished by applying a micro sieve such as nylon or other similar template-like material to a substrate that is coated with an adhesive. The holes in the micro sieve may be, without limitation, approximately ½ the size of the superabrasive particles. A template oriented on the micro sieve can position the superabrasive particles in a pattern. Apexes and edges but not the faces of the superabrasive particles can pass through the micro sieve and into the adhesive. Those faces that do adhere to the adhesive through the micro sieve will not affect the cutting of the tool, as they will be recessed in height as compared to superabrasive particles having tips and edges oriented towards the adhesive, and thus will not contact the CMP pad during dressing.

Following casting of such a tool in an organic material matrix, a portion of the organic material can be removed along with the sieve to expose the superabrasive particles. Care should be taken, however, to carefully control the amount of organic material matrix removed when exposing the superabrasive particles. Removing too much will overexposed the superabrasive particles, and thus cause increased pullout. Removing too little will not expose the superabrasive particles sufficiently to allow efficient penetration for cutting, debris removal, and slurry flow.

One potential method for controlling the depth of removal of the organic material matrix may include disposing stopping aids in the organic material matrix at a controlled depth. The stopping aids can be any material known to one skilled in the art, and may be disposed in the organic material matrix prior to, during, or following curing of the organic material matrix. The stopping aids may also be disposed onto a tool substrate prior to adding the organic material matrix. In one aspect, graphite strips can be glued to stainless steel bars that are placed radially within the organic material matrix where superabrasive particle placement is not required. After curing the organic material matrix, the epoxy and graphite can be abraded away. Abrading will stop when the abrading tool reaches the harder stainless steel bars.

Figure 2:
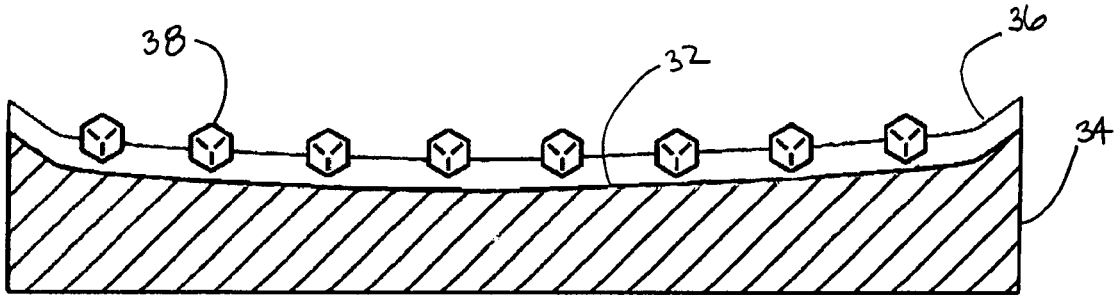
FIG. 2 is a cross-sectional view of superabrasive particles disposed on a temporary substrate in accordance with one embodiment of the present invention.
Figure 3:
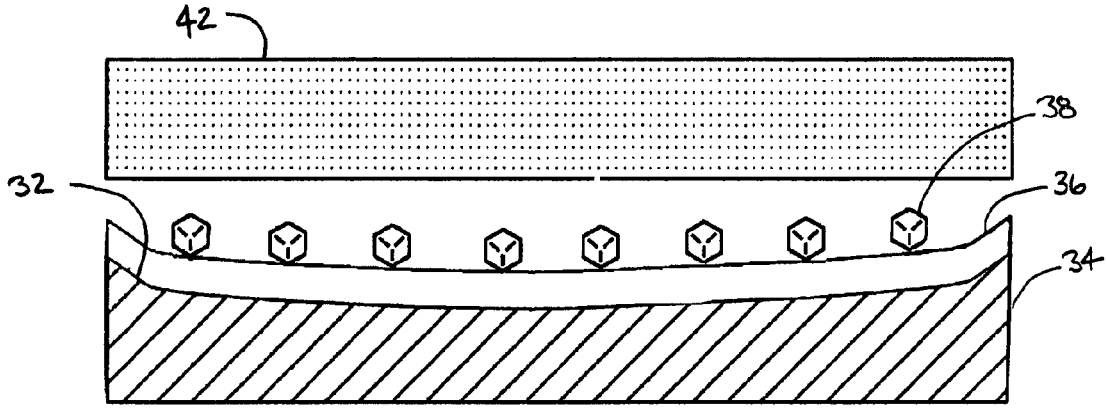
FIG. 3 is a cross-sectional view of superabrasive particles disposed on a temporary substrate in accordance with one embodiment of the present invention.

Various reverse casting methods may be utilized to manufacture the CMP pad dresser of the present invention. As shown in FIG. 2, a spacer layer 36 may be applied to a working surface 32 of a temporary substrate 34. The spacer layer 36 has superabrasive particles 38 at least partially disposed therein, which protrude at least partially from the spacer layer 36 opposite the working surface 32 of the temporary substrate 34. Any method of disposing superabrasive particles into a spacer layer such that the superabrasive particles protrude to a predetermined height may be utilized in the present invention. In one aspect, as shown in FIG. 3, the spacer layer 36 is disposed on working surface 32 of the temporary substrate 34. A fixative may be optionally applied to the working surface 32 to facilitate the attachment of the spacer layer 36 to the temporary substrate 34. Superabrasive particles 38 are disposed along one side of the spacer layer 36 opposite to the working surface 32. A fixative may be optionally applied to the spacer layer 36 to hold the superabrasive particles 38 essentially immobile along the spacer layer 36. The fixative used on either surface of the spacer layer may be any adhesive known to one skilled in the art, such as, without limitation, a polyvinyl alcohol (PVA), a polyvinyl butyral (PVB), a polyethylene glycol (PEG), a pariffin, a phenolic resin, a wax emulsion, an acrylic resin, or combinations thereof. In one aspect, the fixative is a sprayed acrylic glue.

A press 42 may be utilized to apply force to the superabrasive particles 38 in order to dispose the superabrasive particles 38 into the spacer layer 36, as shown in FIG. 2. The press 42 may be constructed of any material know to one skilled in the art able to apply force to the superabrasive particles 38. Examples include, without limitation, metals, wood, plastic, rubber, polymers, glass, composites, ceramics, and combinations thereof. Depending on the application, softer materials may provide a benefit over harder materials. For example, if unequal sizes of superabrasive particles are used, a hard press may only push the largest superabrasive particles through the spacer layer 36 to the working surface 32. In one aspect of the present invention, the press 42 is constructed of a porous rubber. A press 42 constructed from a softer material such as a hard rubber, may conform slightly to the shape of the superabrasive particles 38, and thus more effectively push smaller as well as larger superabrasive particles through the spacer layer 36 to the working surface 32.

The spacer layer may be made from any soft, deformable material with a relatively uniform thickness. Examples of useful materials include, but are not limited to, rubbers, plastics, waxes, graphites, clays, tapes, grafoils, metals, powders, and combinations thereof. In one aspect, the spacer layer may be a rolled sheet comprising a metal or other powder and a binder. For example, the metal may be a stainless steel powder and a polyethylene glycol binder. Various binders can be utilized, which are well known to those skilled in the art, such as, but not limited to, a polyvinyl alcohol (PVA), a polyvinyl butyral (PVB), a polyethylene glycol (PEG), a pariffin, a phenolic resin, a wax emulsions, an acrylic resin, and combinations thereof.

Figure 4:
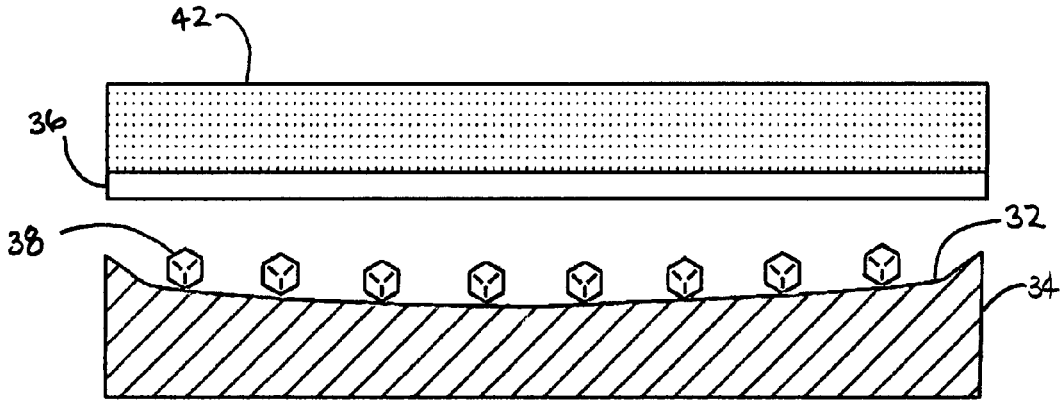
FIG. 4 is a cross-sectional view of superabrasive particles disposed on a temporary substrate in accordance with one embodiment of the present invention.

In another aspect, shown in FIG. 4, the superabrasive particles 38 may be disposed along the working surface 32 of the temporary substrate 34. An adhesive may be optionally applied to the working surface 32 to hold the superabrasive particles 38 essentially immobile along the temporary substrate 34. A spacer layer 36 may then be applied to the working surface 32 such that the superabrasive particles 38 become disposed therein, as shown in FIG. 2. A press 42 may be utilized to more effectively associate the spacer layer 36 with the working surface 32 and the superabrasive particles 38.

Figure 5:
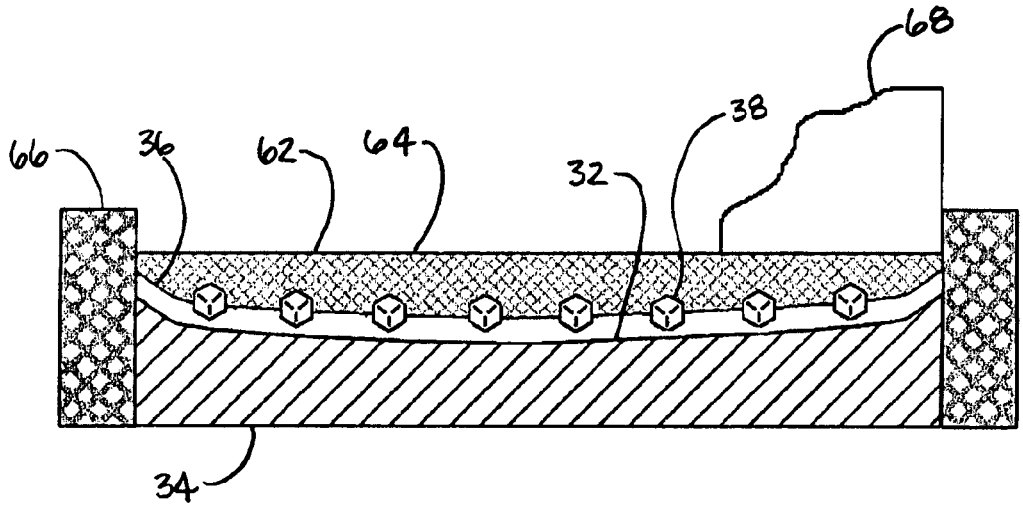
FIG. 5 is a cross-sectional view of superabrasive particles disposed in an organic material layer in accordance with one embodiment of the present invention.

Referring now to FIG. 5, an at least partially uncured organic material 62 may be applied to the spacer layer 36 opposite the working surface 32 of the temporary substrate 34. A mold 66 may be utilized to contain the uncured organic material 62 during manufacture. Upon curing the organic material 62, an organic material layer 64 is formed, bonding at least a portion of each superabrasive particle 38. A permanent substrate 68 may be coupled to the organic material layer 64 to facilitate its use in dressing a CMP pad. In one aspect, the permanent substrate 68 may be coupled to the organic material layer 64 by means of an appropriate fixative. The coupling may be facilitated by roughing the contact surfaces between the permanent substrate 68 and the organic material layer 64. In another aspect, the permanent substrate 68 may be associated with the organic material 62, and thus become coupled to the organic material layer 64 as a result of curing. The mold 66 and the temporary substrate 34 can subsequently be removed from the CMP pad dresser.

Figure 6:
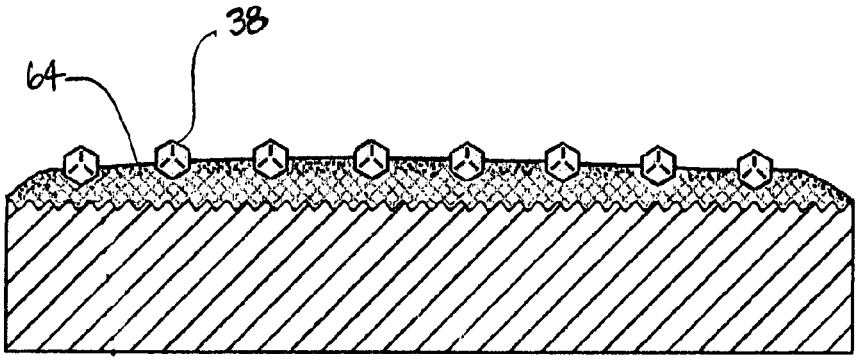
FIG. 6 is a cross-sectional view of a CMP pad dresser in accordance with one embodiment of the present invention.

As shown in FIG. 6, the spacer layer has been removed from the organic material layer 64. This may be accomplished by peeling, grinding, sandblasting, scraping, rubbing, abrasion, etc. The distance of the protrusion of the superabrasive particles 38 from the organic material layer 64 will be approximately equal to the thickness of the now removed spacer layer. The organic material layer 64 may be acid etched to further expose the superabrasive particles 38.

One distinction between the various methods of disposing superabrasive particles into the spacer layer may be seen upon removal of the spacer layer. In those aspects where the superabrasive particles are pressed into the spacer layer, the spacer layer material in close proximity to a superabrasive particle will be deflected slightly towards the working surface of the temporary substrate. In other words, the spacer layer material surrounding an individual superabrasive particle may be slightly concave on the side opposite of the working surface due to the superabrasive particle being pushed into the spacer layer. This concave depression will be filled with organic material during the manufacture of the dresser, and thus the organic material will wick up the sides of the superabrasive particle once the organic material layer is cured. For those aspects where the spacer layer is pressed onto the superabrasive particles, the opposite is true. In these cases, the spacer layer material in close proximity to a superabrasive particle will be deflected slightly away from the working surface of the temporary substrate. In other words, the spacer layer material surrounding an individual superabrasive particle may be slightly convex on the side opposite of the working surface due to the spacer layer being forced around the superabrasive particle. This convex protrusion may cause a slight concave depression in the organic material layer surrounding each superabrasive particle. This slight concave depression may decrease retention, resulting in premature superabrasive grit pullout from the organic material layer. For these aspects, various means of improving retention may be employed by one skilled in the art. For example, the spacer layer may be heated to reduce the slightly convex protrusion of the spacer layer surrounding a superabrasive particle prior to curing the organic material layer. Also, additional organic material may be applied to the slight concave depression in the organic material layer surrounding the superabrasive particle.

The temporary substrate may be made of any material capable of supporting the organic material layer and withstanding the force of the press as described herein. Example materials include glasses, metals, woods, ceramics, polymers, rubbers, plastics, etc. Referring back to FIG. 2, the temporary substrate 34 has a working surface 32 upon which the spacer layer 36 is applied. The working surface 32 can be level, sloped, flat, curved, or any other shape that would be useful in the manufacture of a CMP pad dresser. The working surface 32 may be roughened to improve the orientation of the superabrasive particles 38. When a superabrasive particle is pressed onto a very smooth temporary substrate, it may be more likely that a flat surface of the superabrasive particle will align parallel to the temporary substrate. In this situation, when the spacer layer is removed the flat surface of the superabrasive particle will protrude from the organic material layer. Roughening the surface of the temporary substrate will create pits and valleys that may help to align the superabrasive grit such that the tips of individual superabrasive particle will protrude from the organic material layer.

Figure 7:
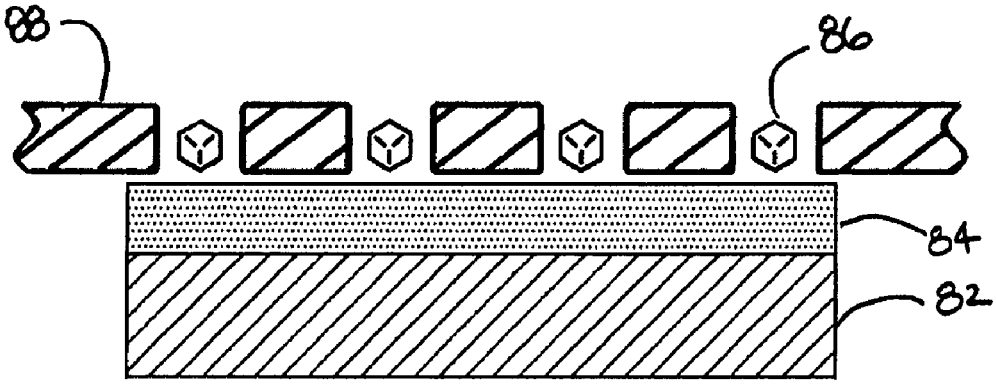
FIG. 7 is a cross-sectional view of superabrasive particles disposed along a layer of organic material in accordance with one embodiment of the present invention.

An alternative aspect of the present invention comprises a method of disposing superabrasive particles in an organic material layer. The method may include providing an organic material arranged as a layer, disposing superabrasive particles on the organic material, pressing the superabrasive particles into the organic material, and curing the organic material to form an organic material layer. FIG. 7 shows a permanent substrate 82 upon which a layer of organic material 84 is applied. Superabrasive particles 86 are disposed along the surface of the layer of organic material 84. A fixative may be utilized to at least partially immobilize the superabrasive particles 86 to the layer of organic material 84. The superabrasive particles 86 may be arranged according to an arrangement by any means known to one skilled in the art. FIG. 7 shows superabrasive particles arranged by means of a template 88.

Figure 8:
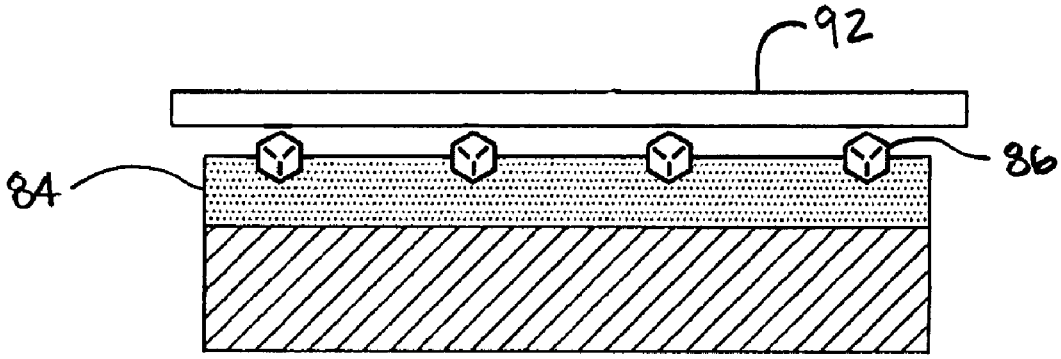
FIG. 8 is a cross-sectional view of superabrasive particles being pressed into a layer of organic material in accordance with one embodiment of the present invention.

Turning to FIG. 8, a press 92 may be utilized to dispose the superabrasive particles 86 at least partially into the layer of organic material 84. In one aspect, the superabrasive particles 86 protrude above the layer of organic material 84 to a predetermined height. The layer of organic material 84 is subsequently cured to form a solidified organic material layer. In one aspect the organic material layer is a thermoplastic resin. In this case the thermoplastic can be softened by heating in order to receive the superabrasive particles 86, and subsequently cooled to cure the thermoplastic into a solidified organic material layer. The layer of organic material 84 can be any organic material known to one skilled in the art, with the proviso that the uncured organic material be viscous enough to support the superabrasive particles prior to curing, or another form of physical support for the superabrasive particles be provided.

The following examples present various methods for making the coated superabrasive particles and tools of the present invention. Such examples are illustrative only, and no limitation on present invention is meant thereby.

EXAMPLES

Example 1

80/90 mesh diamond particles (MBG-660, Diamond Innovations) are arranged with a template on a 100 mm diameter, 10 mm thick flat base plate. The diamond particles form a grid pattern with an inter-diamond pitch of about 500 microns. The plate is placed at the bottom of a steel mold and covered with a polyimide resin powder. Subsequently, the entire assembly is pressed to 50 MPa pressure and 350° C. for 10 minutes. The polyimide consolidated plate is 7 mm thick with nickel coated diamond particles forming a grid on one side. A conventional grinding wheel with silicon carbide grit is used to grind the surface to expose the diamond particles to about 60 microns. The final product is a pad conditioner with uniformly exposed diamonds.

Example 2

The same procedure is followed as Example 1, however a phenolic resin is used in place of the polyimide resin, and the forming temperature is reduced to 200° C.

Example 3

The same procedure is followed as Example 1, however the base plate is precoated with a layer of clay that is about 60 microns thick. After hot pressing, the clay is scraped off, exposing the diamond particles protruding from the polyimide resin layer.

Example 4

The same procedure is followed as Example 1, however the pressed polyimide resin disk is 1 mm thick and is glued on a 420 stainless steel backing to form a pad conditioner.

Example 5

80/90 mesh diamond particles are mixed with an epoxy binder to form a slurry. The slurry is spread over a polyethylene terephthalate (PET) sheet. A blade is used to thin the slurry so that it contains one layer of diamond particles. The epoxy is then cured by an UV light to harden. Subsequently, circular disks are punched out of the epoxy sheet. The disks are glued with an acrylic onto stainless steel substrates with the diamond facing away from the glue. A fine sand paper is used to polish the exposed surface and remove the epoxy until approximately half the height of the diamond particles are exposed. The final product is a pad conditioner with diamond particles securely embedded in an epoxy matrix.

Example 6

80/90 mesh diamond particles are arranged by a template on a PET sheet. Subsequently, an epoxy resin is deposited to cover the single layer of diamond particles. After curing, the PET sheet is punched to form disks. The disks are then glued on stainless steel substrates, and the top surface is then sanded off.

Example 7

A 108 mm diameter plastic sheet is covered on both sides with an adhesive. One side is pressed into a steel mold with a smooth surface that exhibits a slightly concave profile. The slope of the concave profile is about 1/1000. A transition in the concave profile toward the center of the mold functions to avoid a sharp point at the center of the completed tool. About 5 mm from the peripheral edge of the mold the slope increases in order to smoothly transition to the mold edge.

80/90 mesh diamond particles are distributed onto a thin sheet coated with an adhesive that is less tacky than the adhesive coated on the plastic sheet. The diamond particles are arranged on the sheet in a grid having a diamond-to-diamond spacing of about 700 microns. The diamond particles are then transferred to the plastic sheet in the mold. The mold is then enclosed in a ring mold.

An epoxy is poured into the ring mold until the thickness exceeds about 10 mm. The mold system is enclosed in a vacuum environment ($10^{-3}$ torr) to remove air bubbles during the curing of the epoxy. After hardening, the epoxy layer is removed from the mold and the diamond particles are exposed to about ⅓ of the average diamond size. Excess epoxy is machined away from the back of the epoxy layer opposite to the diamond particles to leave a thickness of about 1 mm. The diamond attached epoxy layer is glued to a stainless steel (410) substrate, with the diamonds facing away from the substrate.

Example 8

An acrylic mold is machined to exhibit a radius with a very gentle dishing having an average tangential slope of no greater than 1/1000. The mold is covered with a double stick adhesive. A nylon sieve with an opening of about 100 microns is pressed against the other side of the adhesive. A stainless steel template with holes larger than one diamond size but smaller than two diamond sizes is placed on the top of the nylon sieve. Diamond particles (80/90 mesh, MBG-660 manufactured by Diamond Innovations) are dispersed over the template. The mold is turned upside down to allow diamonds not stuck in the adhesive to fall out. The remaining diamond particles are stuck to the adhesive but, because of the nylon sieve, the large portions of the diamond particles cannot penetrate though to the adhesive. As a result, the diamond particles are stuck with an edge or a tip in the adhesive.

The acrylic mold is placed in a retaining ring and epoxy resin is mixed and poured over the mold and diamond particles. The mold is placed under vacuum to remove air during curing of the epoxy material. The mold is removed mechanically, and the nylon sieve is removed by using a lathe to trim the surface.

Of course, it is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A method of making a superabrasive tool having improved superabrasive particle retention, comprising:

applying a spacer layer to a temporary substrate;

contacting a plurality of superabrasive particles against the temporary substrate by disposing the plurality of superabrasive particles within the spacer layer such that each of the plurality of superabrasive particles contacts the temporary substrate and protrudes from the spacer layer opposite the temporary substrate;

applying an at least partially uncured organic material to the spacer layer opposite the temporary substrate to contact the protruding portions of the plurality of superabrasive particles such that a predetermined space is maintained between the at least partially uncured organic material and the temporary substrate;

curing the at least partially uncured organic material to form an organic material layer that holds the plurality of superabrasive particles; and removing the temporary substrate to expose a portion of each of the plurality of superabrasive particles protruding from the organic material layer.

2. The method of claim 1, wherein disposing the plurality of superabrasive particles within the spacer layer further includes pressing the plurality of superabrasive particles into the spacer layer.

3. The method of claim 2, wherein pressing the plurality of superabrasive particles into the spacer layer further includes pressing with a deformable material.

4. The method of claim 1, further comprising disposing a micro sieve template onto the temporary substrate such that the micro sieve template orients at least a portion of tips of the plurality of superabrasive particles toward the temporary substrate when the plurality of superabrasive particles are contacted against the temporary substrate.

5. The method of claim 1, further comprising roughening the temporary substrate to orient at least a portion of tips of the plurality of superabrasive particles toward the temporary substrate when the plurality of superabrasive particles are contacted against the temporary substrate.

6. The method of claim 1, wherein the plurality of superabrasive particles contacts the temporary substrate along a flat surface.

7. The method of claim 1, wherein the plurality of superabrasive particles contacts the temporary substrate along a slopped surface.

8. The method of claim 7, wherein the slopped surface has a single slope.

9. The method of claim 7, wherein the slopped surface has multiple slopes.

10. The method of claim 1, wherein a portion of the plurality of superabrasive particles contacts the temporary substrate along a flat surface and a portion of the plurality of superabrasive particles contacts the temporary substrate along a slopped surface.

11. The method of claim 1, wherein the plurality of superabrasive particles contacts the temporary substrate along a curved surface.

* * * * *